US008100359B2

(12) United States Patent
Al-Qaffas

(10) Patent No.: US 8,100,359 B2
(45) Date of Patent: Jan. 24, 2012

(54) INTERCEPT SYSTEM FOR FALLING BOMBS

(76) Inventor: Qasem Awadh Al-Qaffas, House (KW)

( * ) Notice: Subject to any disclaimer, the term of this patent is extended or adjusted under 35 U.S.C. 154(b) by 389 days.

(21) Appl. No.: 12/415,006

(22) Filed: Mar. 31, 2009

(65) Prior Publication Data

US 2010/0243799 A1 Sep. 30, 2010

(51) Int. Cl.
*B64F 1/02* (2006.01)

(52) U.S. Cl. ..... 244/110 C; 244/1 TD; 244/3.1; 89/1.11

(58) Field of Classification Search ..... 244/110 C, 244/1 TD, 3.1; 89/1.11, 1.13
See application file for complete search history.

(56) References Cited

U.S. PATENT DOCUMENTS 4,231,311 A * 11/1980 Longerich ..... 114/244
4,768,417 A * 9/1988 Wright ..... 89/1.11
RE34,873 E * 3/1995 Luttrell ..... 273/360
5,583,311 A * 12/1996 Rieger ..... 89/1.11
5,675,104 A * 10/1997 Schorr et al. ..... 89/1.13
6,182,553 B1 * 2/2001 Peterson ..... 89/1.11
6,394,016 B2 * 5/2002 Swartout et al. ..... 114/254
6,626,077 B1 * 9/2003 Gilbert ..... 89/1.11
6,957,602 B1 * 10/2005 Koenig et al. ..... 89/1.11
7,028,947 B2 * 4/2006 Burns ..... 244/1 TD
7,190,304 B1 * 3/2007 Carlson ..... 342/62
7,328,644 B2 * 2/2008 Vickroy ..... 89/1.11
7,786,417 B2 * 8/2010 Sells, II ..... 244/3.1
7,900,548 B2 * 3/2011 Hoadley et al. ..... 89/36.17
2006/0169832 A1 * 8/2006 Glasson ..... 244/3.1

* cited by examiner

*Primary Examiner* — Michelle Clement
(74) *Attorney, Agent, or Firm* — Lowe Hauptman Ham & Berner LLP

(57) ABSTRACT

An intercept system for destroying a falling bomb includes a packable structure including a compressed expandable net of break resistant cords, a radio altimeter and a deployment mechanism for expanding and deploying the net below a falling bomb. The system also includes an explosive charge and a detonator for detonating the explosive charge when the detonator comes into contact with a bomb. A shoulder fired missile launcher propels the packable structure into the air below a falling bomb. The structure also includes a timer, responsive to the radio altimeter to detonate the explosive charge if a bomb is not encountered within a pre-selected amount of time.

2 Claims, 6 Drawing Sheets

INTERCEPT SYSTEM FOR FALLING BOMBS

FIELD OF THE INVENTION

This invention relates to an intercept system for falling bombs and more particularly to an intercept system for destroying a falling bomb before it reaches its target.

BACKGROUND FOR THE INVENTION

The defense industry has developed a number of products to protect a Country against a military attack. For example, considerable efforts have been made to develop complex systems as a defense against incoming missiles. Nevertheless, it is Applicant's understanding that these missile defense systems are relatively complex, expensive and primarily directed to defend a Country against incoming missiles.

Other developments relate to intercept devices for flying objects such as a manned aircraft. For example, a U.S. Pat. No. 5,583,311 of Rieger discloses an Intercept Device for Flying Objects. As disclosed, an intercept device for flying objects is formed of a lightweight, small-volume, packable structure made of a tear-resistant, pliable material which can be stretched to a large two dimensional or three dimensional expansion by means of a deployment device. To reduce the velocity of the intercepted flying objects, activatable aerodynamic resistance bodies are incorporated into the structure. To end the intercept procedure, elements are integrated into the structure which consists of material that can be destroyed from outside by means of high energy beams and/or chemical reagents, or that destroys itself, or the structure as a whole consists of such material.

A more recent approach to a defense system is disclosed in a U.S. Pat. No. 6,626,077 of Gilbert for an Intercept Vehicle for Airborne Nuclear, Chemical or Biological Weapons of Mass Destruction. As disclosed therein, an intercept device for flying objects made of a light-weight packable structure made of a pliable, tear resistant material that can be expanded to a large web-like structure by means of a deployment device, into the path of a flying weapon. To capture, hold and reduce the velocity of intercepted flying objects, activatable resistance bodies are incorporated into uniformly distributed masses that are connected to the perimeter of the web-like structure. Contractible sections of the web, made of cable like structures, connected to perimeter masses, act as drawstrings upon collision with a flying object. This causes closure of the web around the flying object as a result of the mass's inertia and added resistance from deployable resistance structures that place tension on drawstring structures of the web. The flying object is subsequently captured within the web, held secure and it's velocity rapidly reduced.

Notwithstanding the above, it is presently believed that there is a need and a potential market for an intercept device according to the present invention. There is a need because the intercept device according to the present invention is designed specifically as a defense against falling bombs and to destroy such bombs before they reach their target. Further as presently contemplated, the devices are of relatively simplified design, relatively inexpensive and should be more effective in surrounding and destroying falling bombs than a missile.

BRIEF SUMMARY OF THE INVENTION

In essence, the present invention relates to an intercept system and/or device for destroying a falling bomb before the bomb reaches a target. The intercept device comprises a packable structure including a compressed expandable net of pliable break resistant cords being expandable into an open mesh net for engaging and engulfing a falling bomb. The intercept device also includes a sensor such as a radio altimeter, optical sensor or laser sensor disposed in the structure for deploying the open mesh net at a pre-selected altitude or upon sensing a bomb in the vicinity of the packable structure. The deployment means activated by the sensor opens and expands the net below the bomb. An explosive charge is disposed within the structure and includes a detonator for exploding the charge when the detonator comes into contact with a bomb to thereby destroy or disable the bomb. The structure also includes means for propelling the packable structure into the vicinity of falling bombs and timer means for discharging the explosive charge if the net fails to encounter a bomb within a pre-selected period of time.

The invention also contemplates a method for destroying a falling bomb including the following steps i.e. providing a packable structure including a compressed expandable net and means for launching a propelling the structure upwardly into an area for intercepting falling bombs. The method also includes the step of providing a sensor for sensing an altitude or one or more bombs and means such as an explosive charge for deploying the net below a falling bomb. After deploying the net below a falling bomb, the net tends to engulf the bomb and a detonator detonates an explosive charge to destroy the bomb. Also, in the event that the net does not encounter a bomb, the detonator automatically detonates the charge after a predetermined time to avoid a live charge falling to earth.

The invention will now be described in connection with the following drawings.

DESCRIPTION OF THE PREFERRED EMBODIMENTS OF THE INVENTION

A delivery system or launch vehicle may be of conventional design and is provided for the propulsion, guidance and delivery of an intercept device to an intended location into the path of a falling bomb. This launch vehicle can be a conventional rocket or shoulder fired missile or other appropriate launcher. It is assumed that the launch vehicle has a means or mechanism for deployment of the intercept device or net bearing explosive into an open two or three dimensional web adapted to engulf a falling bomb.

In practice, a web like net is packaged in the launch vehicle such as a shoulder fired missile and is adapted to be rapidly open and deployed by any appropriate means. For example the net can be opened by small embedded explosives about its periphery that propel portions of this net away from one another and into an open net. This net can be made from numerous polymeric fibers or combinations thereof i.e. Kevlar™, high strength aramid fibers from Dupont. Other materials such as fiberglass mesh, carbon fibers etc. may be used to form a light-weight strong web that can withstand the extreme stress of an impact by a falling bomb.

Figure 1:
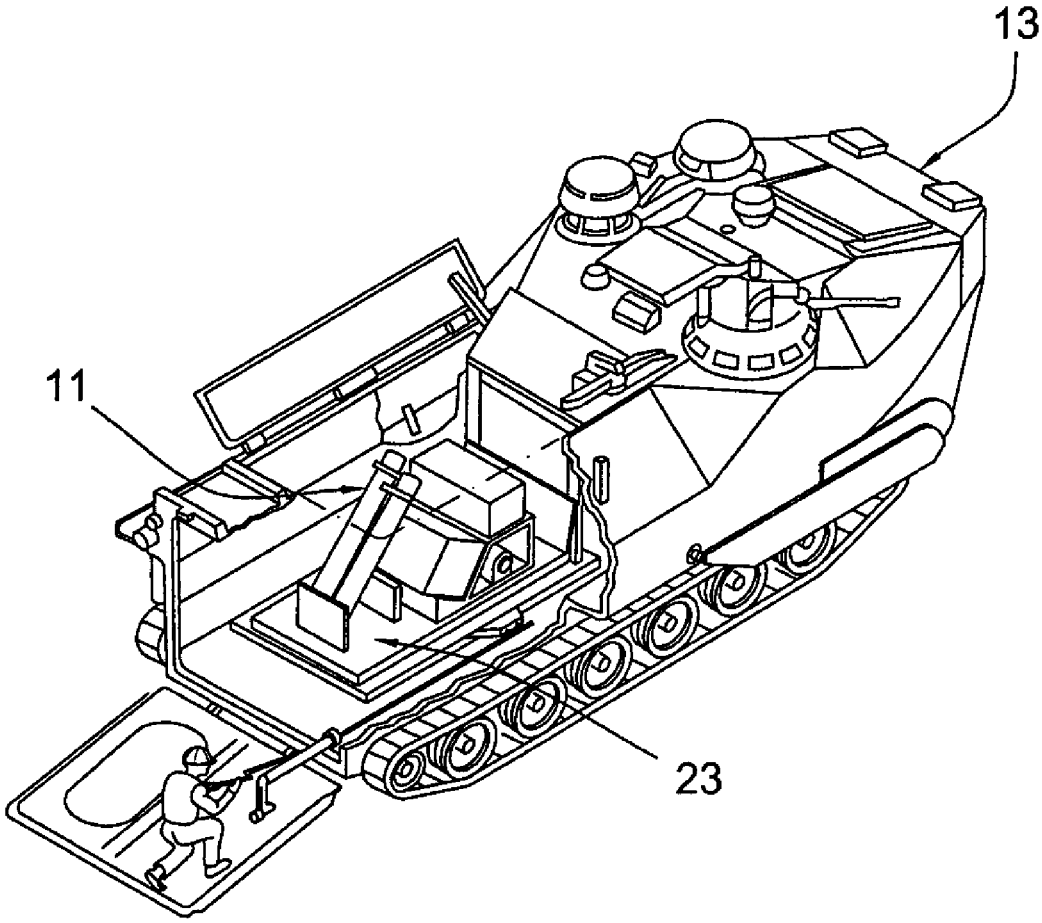
FIG. 1 PRIOR ART
FIG. 1 a prior art rocket launcher mounted on an amphibious assault vehicle with a portion of the equipment being cut away to more clearly show the launch assembly.

Referring now to FIG. 1, a prior art explosive delivery system 11, is mounted on an amphibious assault vehicle 13. The launcher 11 provides means for reliably propelling, positioning and deploying an explosive net in the vicinity of but under one or more falling bombs. As shown in FIG. 1 the system 11 is mounted on an assault vehicle 13 on a suitable base or pallet 23. It should be recognized that any suitable launcher can be mounted on any suitable vehicle. It is also contemplated that a small intercept device could be launched from a shoulder fired missile launcher.

Figure 2:
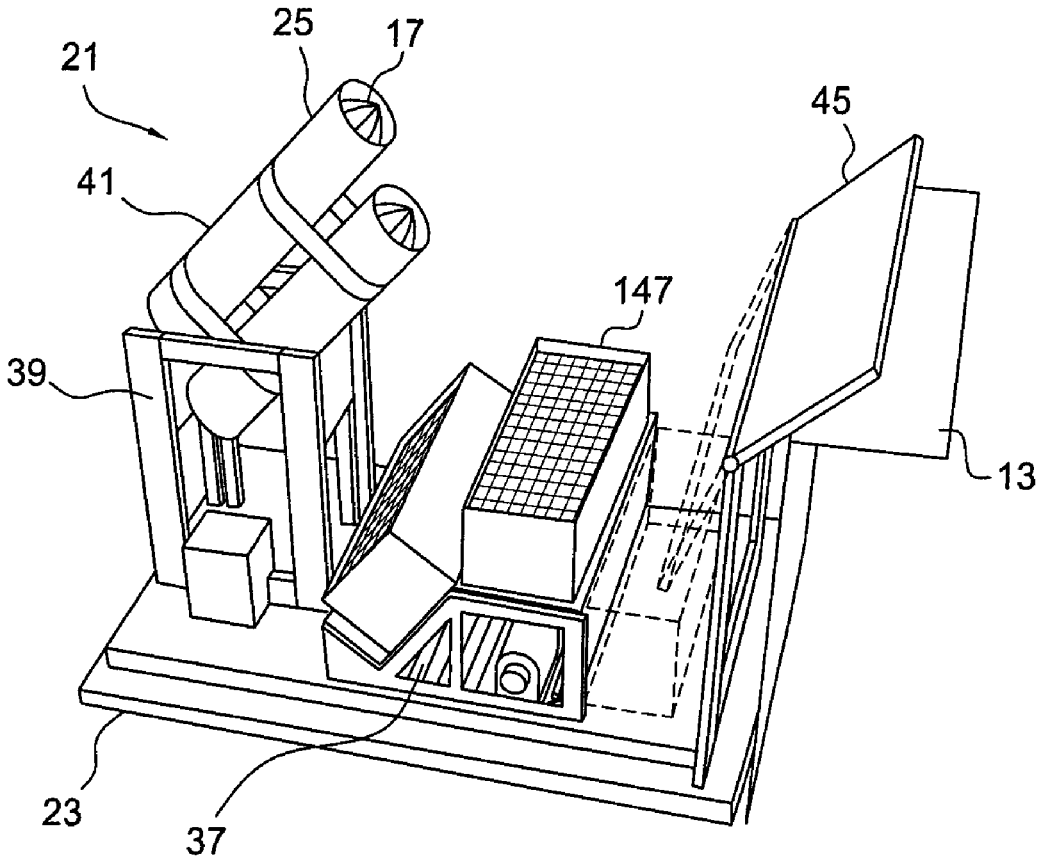
FIG. 2 PRIOR ART
FIG. 2 is a perspective view of the rocket launcher shown in FIG. 1.
Figure 3:
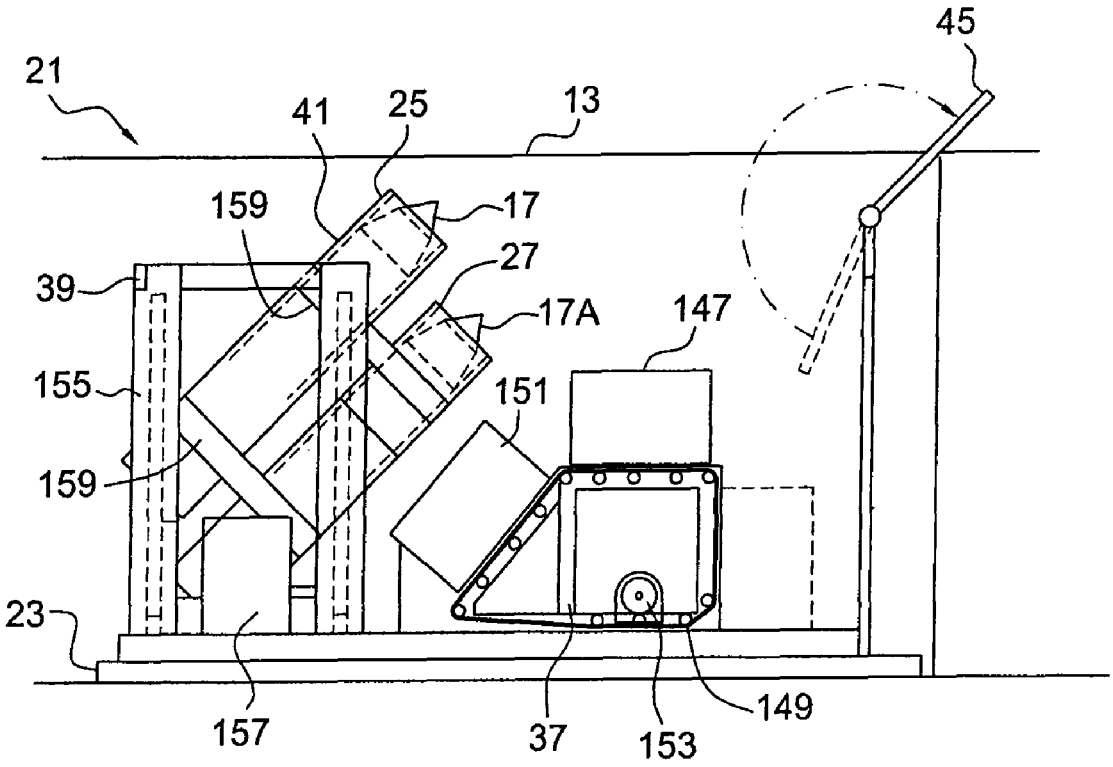
FIG. 3 PRIOR ART
FIG. 3 is a side elevational view of the rocket launcher shown in FIGS. 1 and 2.

The delivery system 11 as shown in FIGS. 2 and 3 includes a pallet or base 23, launch tubes 25 and 27 which are part of a sub-assembly 21. The launch tubes 25 and 27 are essentially identical and of a conventional design as will be well understood by persons of ordinary skill in the art of launch tubes used in propelling weapons. The sub-assembly or launcher 21 includes a magazine positioning apparatus 37, launcher lifting apparatus 39, rocket launcher tube assembly 41 and array detector 45. A chest 47 may also be provided for holding a supply of rocket assemblies and/or intercept devices. The details of a delivery system that is appropriate for the present invention are disclosed in the U.S. Pat. No. 5,417,139 of Boggs et al. that is incorporated herein in its entirety by reference.

As shown in FIG. 3, the launcher assembly 21 includes magazine positioning, sub-assembling 37, launcher lifting sub-assembly 39, rocket launch tube assembly 41, and pallet 23 with rails and a net deflector.

Magazine positioning assembly 37 consists of a support frame and conveyer 149, two explosive chests 147, 151 and a motor/gear assembly 153. FIG. 2 depicts an elevation view of the rocket launcher assembly 21. Its purpose is to provide support to the explosive chests 147 and 151 and a physical interface for bolting the motor/gear assembly 153 into position. Additionally, conveyer 149 positions one explosive chest 147 on top for firing and then rotates forward when the first net has been deployed. The explosive chest 147 and 151 are aluminum boxes without lids into which removable fiber box inserts are placed. A net 19 is actually stored in each such fiber insert. The fiber inserts are disposable containers that have the nets in them so that the explosive chests are reusable. Each explosive chest 147 and 151 is not sealed but the inserts are sealed with an aluminum sealing cover that has a heat resistant ceramic coating. The gear/motor assembly 153 is controlled from a console and rotates conveyer 149 to position the explosive chest 147 and 151 as required.

Launcher lifting sub-assembly 39 raises the tube assembly 41 for firing to increase clearance between the rockets and the vehicle and then lowers tube assembly 41 for transport. The launcher lifting assembly 39 includes lift guides 155 and electric lift cylinder 157. The mechanical action is extension of the electric lift cylinder vertically with alignment of longitudinally assembly 41 maintained by launcher lifting guides 155.

The launch tube sub-assembly 41 includes the two launch tubes 25 and 27 and a stabilizer 159. The two launch tubes 25 and 27 are non-rifled.

Figure 4:
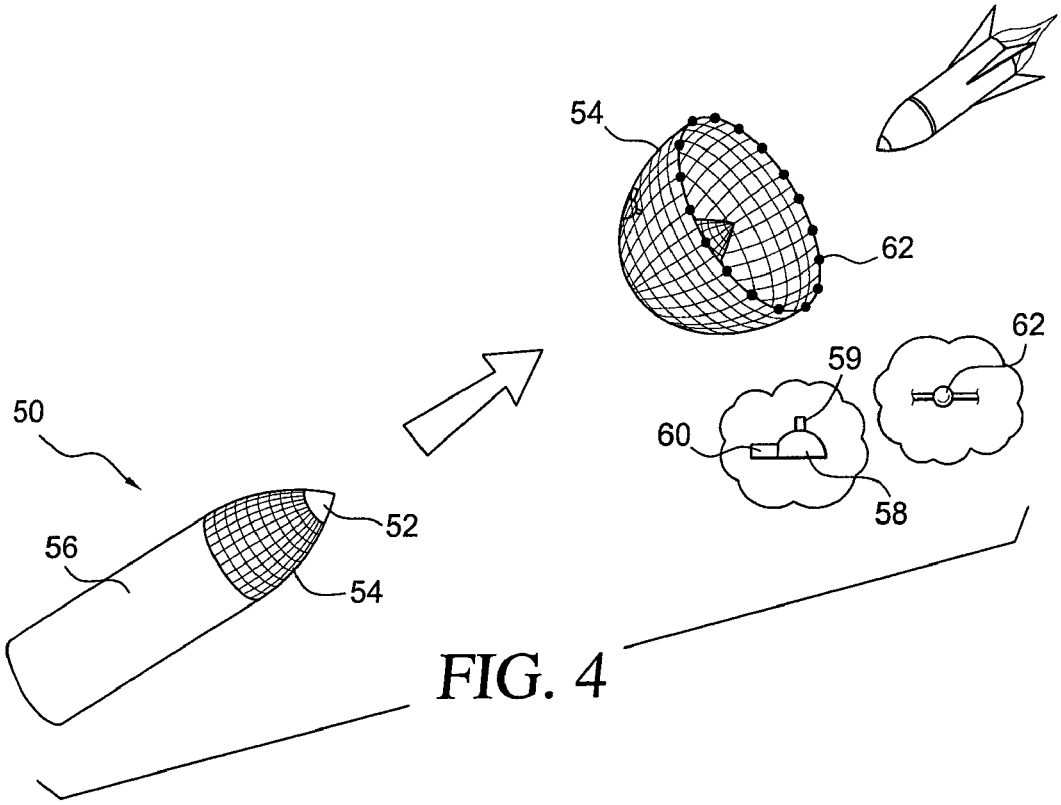
FIG. 4 is a schematic illustration of an intercept device in accordance with a first embodiment of the invention.

FIG. 4 illustrates an intercept device 50 that includes a radio altimeter 52 or possibly an optical or laser sensor. The device 50 also includes a net 54 as well as a missile 56 for propelling the intercept device upwardly into the air and below one or more falling bombs. Conventional guidance systems may also be incorporated to position the net 54 below one or more falling bombs.

In a preferred embodiment of the invention, a radio altimeter is provided for opening or deploying the net 54 below one or more falling bombs. The selected altitude is based on conventional calculations based on timing from release of the bombs or arrival of the aircraft over the target and at sufficient altitude so that the target will not be destroyed by detonation of the charge and bomb.

It is also contemplated that an optical or laser sensor can be used to deploy the net when a bomb is sensed above the intercept device. For example, various types of sensors are disclosed on a website of IFM FECTOR INC. The selection and/or modification of such sensors is believed to be with the skill of a person of ordinary skill in the art.

The present invention also contemplates the use of an explosive charge 58 and detonator 59 deployed within the net 54 for discharging the explosive charge when contacted by a bomb to thereby destroy the bomb. Another important element in the present invention relates to a timer 60 activated by the altimeter 52 and programmed to activate the explosive charge after a predetermined time if the net has not encountered or snared a bomb. This element prevents unexploded charges from falling to the ground and perhaps injuring children or other innocent individuals at some time in the future.

The intercept device in accordance with a preferred embodiment of the invention also includes deployment means 62 such as small charges or rockets deployed around the outer periphery of the net 54. It is also contemplated that the deployment can also take place by means of an explosive self-destruct of the rocket as triggered by the altimeter.

Figure 5:
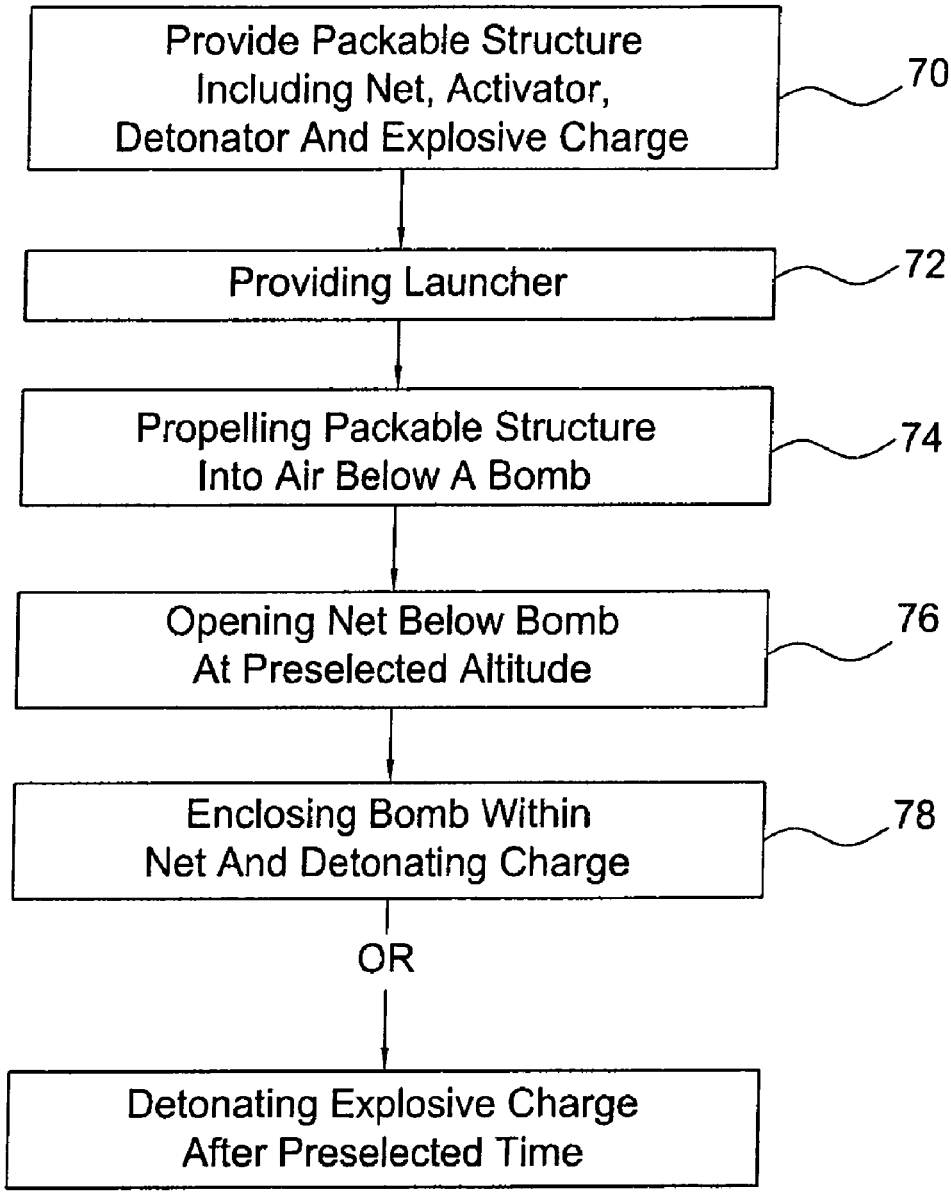
FIG. 5 is a block diagram illustrating a method in accordance with a second embodiment of the invention.
Figure 6:
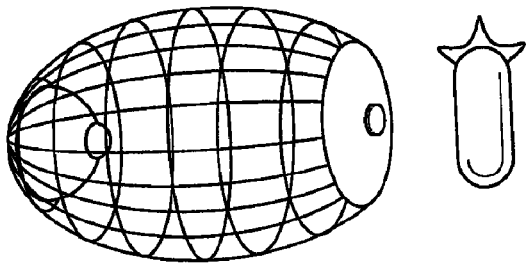
FIG. 6 illustrates a net as launched by a missile and including a sensor with a light cell.
Figure 7:
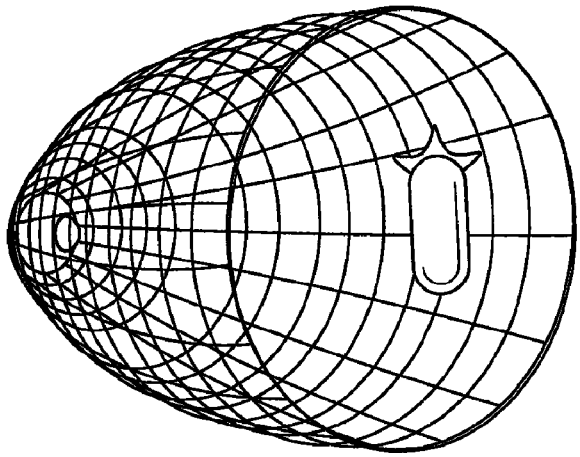
FIG. 7 illustrates the net as it encounters a bomb within its structure.

A method for intercepting and destroying a falling bomb will now be described in connection with FIG. 5. As shown, in FIG. 5, the method includes the steps of providing a packable structure including a net, activator, detonator and explosive charge in step 70 and providing a shoulder fired missile launcher in step 72. The shoulder fired missile launcher is constructed and arranged in a conventional manner. The packable structure is propelled upwardly by the rocket launcher or shoulder fired missile in step 74 and opened, that is the net is deployed, below the level of one or more bombs in step 76. As a bomb strikes the net, the net closes over and around the bomb (see FIG. 8) to bring the bomb into contact with the detonator to thereby explode the explosive charge and destroy the bomb in step 78. The net is designed to withstand the explosion and contain the exploded bomb and shrapnel therefrom within the enclosed net.

However, in the event that the net does not encounter or capture a bomb, a timer is provided for detonating the explosive charge in order to avoid unexploded charges falling to the ground. For example, in step 80, the altimeter upon reaching its pre-selected altitude not only deploys a net, but also initiates the start of a timer. Then after a pre-selected time, the timer initiates a signal to detonate the explosive charge in step 80.

Figure 8:
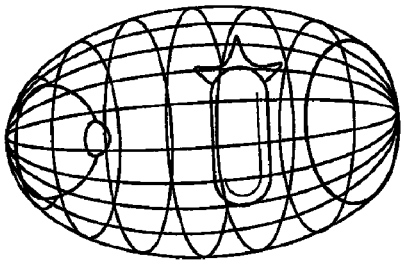
FIG. 8 shows the net surrounding a bomb with the net closed over the bomb as a result of sensors at the net edges.
Figure 9:
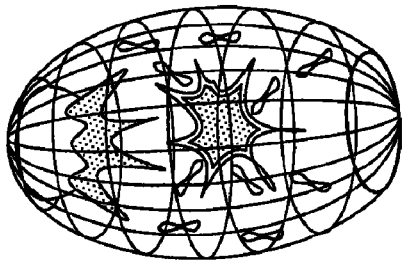
FIG. 9 shows the net including an exploded bomb and the shrapnel as a result of the explosion.

As illustrated in FIGS. 6-9 a net as launched by a missile or shoulder fired missile launcher, includes a sensor on a front surface thereof with a light cell. The light cell includes a switch that closes on detecting a bomb and causes the net to close over and surround the bomb. FIG. 8 illustrates the effect of closing the net over a bomb and bringing the bomb into contact with a detonator. As shown in FIG. 9, the net which is made of strong fabric, withstands the explosion and prevents any falling shrapnel from dispersed over a wide area.

While the invention has been described in connection with its preferred embodiments it should be recognized that changes and modifications may be made therein without departing from the scope of the appended claims.

What is claimed is:

1. An intercept device for destroying a falling bomb before the bomb reaches a target, said device consisting of:

a packable structure and a rocket launcher for propelling said packable structure into the air to an altitude beneath one or more falling bombs and wherein said packable structure includes a compressed expandable net of pliable high strength aramid break resistant cords; and wherein said rocket launcher includes a launch vehicle, a base, a launch tube, a magazine, a magazine positioning apparatus, a launch tube lifting apparatus that provides for the propulsion guidance and deliver of said packable structure to an intended location into the path of a falling bomb;

said packable structure includes a first explosive charge for deploying said net into an open web for engaging and engulfing a falling bomb;

a sensor including a radio altimeter disposed in said packable structure for sensing an elevation below a falling bomb with said packable structure in proximity thereto;

deployment means including said first explosive charge activated by said sensor for opening and expanding said web below a falling bomb;

a second explosive charge disposed within said packable structure and surrounded by said net and a detonator for exploding said charge when said detonator comes into contact with a bomb to thereby disable the bomb;

means for propelling said packable structure into the vicinity of a falling bomb; and timer means for discharging said second explosive charge at a pre-determined time if said net fails to ensnare or disable a bomb.

2. A method for detecting and destroying a falling bomb before the bomb reaches it's target, said method consisting of the following steps:

providing a packable structure including a compressed expandable and pliable net of break resistant high strength aramid cords, a radio altimeter and a plurality of small explosive charges for expanding said net, an optical sensor for detecting a bomb above the packable structure and a separate explosive charge and a detonator;

providing a rocket launcher for propelling said packable structure into the air and wherein said rocket launcher includes a launch vehicle, a base, a launch tube, a magazine, a magazine positioning apparatus, a launch tube lifting apparatus that provides for the propulsion, guidance and delivery of said packable structure to an intended location into the path of a falling bomb;

propelling the packable structure into the air below a falling bomb;

deploying the expandable net below a falling bomb;

engulfing the falling bomb in the net;

exploding the explosive charge when a bomb comes into contact with the detonator; and activating the explosive charge at a given altitude or after a give time if the charge did not go off in response to a bomb coming into contact with the detonator.

* * * * *